US011355856B2

(12) United States Patent
Yang et al.

(10) Patent No.: US 11,355,856 B2
(45) Date of Patent: Jun. 7, 2022

(54) METHOD OF ARRANGING A LEAKY COAXIAL CABLE BY USING TWO HALF JUMPER WIRES FOR CONNECTING TWO LEAKAGE COAXIAL CABLES TOGETHER

(71) Applicant: JIANGSU HENGXIN TECHNOLOGY CO., LTD, Yixing (CN)

(72) Inventors: ZhiXing Yang, Yixing (CN); Zhonghua Liu, Yixing (CN); Huiyi Jin, Yixing (CN); Cenjia Lv, Yixing (CN); Guang Wu, Yixing (CN); Yongping Shi, Yixing (CN); Bin Chen, Yixing (CN)

(73) Assignee: Jiangsu Hengxin Technology Co., Ltd, Yixing (CN)

( * ) Notice: Subject to any disclaimer, the term of this patent is extended or adjusted under 35 U.S.C. 154(b) by 90 days.

(21) Appl. No.: 16/497,246

(22) PCT Filed: Aug. 27, 2018

(86) PCT No.: PCT/CN2018/102434
§ 371 (c)(1),
(2) Date: Sep. 24, 2019

(87) PCT Pub. No.: WO2020/029338
PCT Pub. Date: Feb. 13, 2020

(65) Prior Publication Data

US 2020/0358199 A1 Nov. 12, 2020

(30) Foreign Application Priority Data

Aug. 7, 2018 (CN) ..... 201810892605.4

(51) Int. Cl.
*H01Q 13/20* (2006.01)
*H01Q 13/22* (2006.01)

(52) U.S. Cl.
CPC ..... *H01Q 13/203* (2013.01); *H01Q 13/22* (2013.01)

(58) Field of Classification Search
CPC ..... H01Q 13/203; H01Q 13/20; H01Q 13/22; H01Q 13/28
USPC ..... 333/237
See application file for complete search history.

(56) References Cited

U.S. PATENT DOCUMENTS 4,152,648 A * 5/1979 Delogne ..... H04B 5/0018 455/523
6,867,596 B1 3/2005 Mizuno
9,620,860 B2 * 4/2017 Asplund et al. ..... H01Q 13/203
(Continued)

FOREIGN PATENT DOCUMENTS

CN 2716977 Y 8/2005
CN 201213151 Y 3/2009
CN 201311794 9/2009
(Continued)

*Primary Examiner* — Benny T Lee
(74) *Attorney, Agent, or Firm* — Vivacqua Crane PLLC

(57) ABSTRACT

A method of arrangement of a leaky coaxial cable combination structures, comprising: providing at least two leakage coaxial cables, each of the at least two leakage coaxial cables has a narrow body; and providing a jumper wire mechanism between at least two leakage coaxial cables; wherein the jumper wire mechanism has two ends, and the two ends are respectively connected to one end of each of the at least two leakage coaxial cables.

6 Claims, 7 Drawing Sheets

(56) References Cited

U.S. PATENT DOCUMENTS

2010/0001817 A1* 1/2010 Suzuki et al. ..... H01Q 1/3225
333/237

FOREIGN PATENT DOCUMENTS

| | | | |
|---|---|---|---|
| CN | 201789055 | U | 4/2011 |
| CN | 103268973 | A | 8/2013 |
| CN | 106601326 | A | 4/2017 |
| CN | 107464971 | A | 12/2017 |
| CN | 107706536 | A | 2/2018 |

* cited by examiner

METHOD OF ARRANGING A LEAKY COAXIAL CABLE BY USING TWO HALF JUMPER WIRES FOR CONNECTING TWO LEAKAGE COAXIAL CABLES TOGETHER

CROSS REFERENCE TO RELATED APPLICATIONS

This application is a national stage application under 35 U.S.C. 371 of PCT Application No. PCT/CN2018/102434, filed on 27 Aug. 2018, which PCT application claimed the benefit of Chinese Patent Application No. 2018108926054 filed on 7 Aug. 2018, the entire disclosure of each of which are hereby incorporated herein by reference.

TECHNICAL FIELD

The present disclosure relates to the technical field of arrangement of leaky coaxial cables, and in particular, to a method for arrangement of leaky coaxial cables applied to a strip-shaped elongated area.

BACKGROUND

In strip-shaped elongated areas such as tunnels, and mines, wireless communication is set up generally by using leaky coaxial cables. The radiation field intensity of the leaky coaxial cables is uniform and is not affected by factors such as tunnel curvature and slope. In the prior art, when leaky coaxial cables are arranged in an elongated area, the leaky coaxial cables are respectively connected, by means of jumper wires located in a central area along the length direction of the elongated area, to leaky coaxial cables symmetrically arranged at both sides. The grooving parameters (size and quantity of grooves) of outer conductors of two symmetrically-arranged leaky coaxial cables are identical. The jumper wire is generally short (1-2 m) in length. Since the transmission loss of the leaky coaxial cable is increased with the coverage radius, the general coverage radius is designed due to considerations of the "end field intensity plus engineering margin". Due to engineering margin considerations, the situation in which the switching is not timely and switching cannot be performed normally also often occurs in the tail end switching area, which requires subsequent improvement and solution through other measures. Moreover, this situation is often accompanied by a low signal-to-noise ratio, thereby affecting the communication quality. Especially with the development of Multiple-Input Multiple-Output (MIMO) technology, the application of the leaky coaxial cable-based MIMO technology is more and more widely used. If a high signal-to-noise ratio cannot be guaranteed at the tail end of the leaky coaxial cable, the MIMO effect will be severely affected, or even the MIMO effect cannot be achieved at all. In this case, the communication effect is not even as good as that of a Single-Input Single-Output (SISO) system.

In summary, referring to FIG. 1, in the existing method for arrangement of leaky coaxial cables applied to a strip-shaped elongated area, the leaky coaxial cables symmetrically arranged at both sides are connected respectively by means of jumper wires located in a central area along the length direction of an elongated area, and grooving parameters (size and quantity of grooves) of outer conductors of the two symmetrically-arranged leaky coaxial cables are identical, where the length of the jumper wire is generally short (1-2 m) in length and only plays the role of jumping. The defects are as follows: excessive field intensity at the initial end of the leaky coaxial cable, too long tail end switching area, being difficult to switch the switching area, and low signal-to-noise ratio.

SUMMARY OF THE INVENTION

Regarding the aforementioned problem, the present disclosure provides a method for arrangement of leaky coaxial cables applied to a strip-shaped elongated area, which can avoid weakening the field intensity at an initial end of a leaky coaxial cable, improve a signal-to-noise ratio of an end signal coverage area, shorten the length of the leaky coaxial cable among a signal switching area, make the switching process for the switching area being stable, and make the switching process for the switching area being smooth.

A method of arrangement of a leaky coaxial cable combination structures, comprising: providing two leakage coaxial cables, each of the at least two leakage coaxial cables has a narrow body; and providing a jumper wire mechanism between the two leakage coaxial cables; wherein the jumper wire mechanism has two ends, and the two ends are respectively connected to a corresponding end of each of the at least two leakage coaxial cables, wherein the jumper wire mechanism comprises two half jumper wires, one end of one of the two half jumper wires is connected to one end of the leakage coaxial cable, and the other end of the one half jumper wire of the two half jumper wires is connected to one end of the other half jumper wire.

The method is further characterized as follows.

Each of the leaky coaxial cable combination structures includes a leaky coaxial cable with initial and tail ends and a half jumper wire, where the half jumper wires of the leaky coaxial cable combination structures of the two areas are combined to form an integral jumper wire. Two opposite ends of the jumper wire along the length direction are respectively connected to tail ends of corresponding leaky coaxial cables located at the two opposite ends, initial ends of two of the leaky coaxial cables are located at two opposite ends of the strip-shaped elongated area along the length directions. A slot hole on each of the leaky coaxial cables has at least two different slot hole parameters, and the slot hole parameters include, but are not limited to, a slot hole shape, a gradient pitch, a groove width, a groove length, a grooving inclination angle, a hole spacing, and a combined slot hole pattern.

The slot hole shape is V-shape, U shape, vertical strip shape, or inclined strip shape.

Each of the leaky coaxial cables includes slot holes having at least two pitches; a groove group composed of slot holes with a large pitch is disposed at the initial end of the leaky coaxial cable, and a groove group composed of slot holes with a small pitch is disposed at the tail end of the leaky coaxial cable.

Each of the leaky coaxial cables includes slot holes having at least two groove lengths, wherein a groove group composed of slot holes with a relatively small groove length is disposed at the initial end of the leaky coaxial cable, and a groove group composed of slot holes with a relatively large groove length is disposed at the tail end of the leaky coaxial cable.

Each of the leaky coaxial cables includes slot holes having at least two groove widths; a groove group composed of slot holes with a relatively small groove width is disposed at the initial end of the leaky coaxial cable, and a groove group composed of slot holes with a relatively large groove width is disposed at the tail end of the leaky coaxial cable.

Each of the at least two leaky coaxial cables comprises a first slot group and a second slot group; wherein the first slot group is provided at one end of each of the two leaky coaxial cables, and the first slot group comprises several first slot holes, which have a first pitch; wherein the second slot group is provided at the other end of each of the two leaky coaxial cables, and the second slot group comprises several second slot holes, which have a second pitch smaller than the first pitch.

Each of the leaky coaxial cables has at least two grooving shapes. The grooving shapes is V shape and U shape. A groove group with a good transmission performance is disposed at the initial end of the leaky coaxial cable, and a groove group with a good radiation performance is disposed at the tail end of the leaky coaxial cable.

In an implementation, one leaky coaxial cable is provided with at least two groups of slot holes, including, but not limited to, the above-mentioned five modes used separately or in combination. When the above-mentioned five modes are combined, the modes need to be arranged according to the above-mentioned rules, and there is a negative correlation between the number of slot groups and the comprehensive loss. For specific grooving parameters (size and quantity of grooves), reference is made to the performance of the leaky coaxial cable when the respective grooving parameters (size and quantity of grooves) exist separately.

Each of the leaky coaxial cable combination structures includes a first leaky coaxial cable, a transition jumper wire, and a second leaky coaxial cable, wherein the second leaky coaxial cables of the leaky coaxial cable combination structures of the two areas are combined to form an integral second leaky coaxial cable, and two opposite ends of the second leaky coaxial cable along the length direction are respectively connected to inner ends of the corresponding transition jumper wires at two opposite ends. Outer ends of each of the transition jumper wires are respectively connected to the tail ends of the first leaky coaxial cable, and initial ends of two of the first leaky coaxial cables are located at two opposite ends of the strip-shaped elongated area along the length direction.

The configuration (volume and size) of the second leaky coaxial cable is smaller than that of the first leaky coaxial cable. The slot hole parameters of the first leaky coaxial cable and second leaky coaxial cable are the same, and the second leaky coaxial cable with a smaller configuration (volume and size) is selected according to a design requirement for switching, so as to achieve an objective of smoothly increasing an end transmission loss and reducing the size of a switching area. Moreover, due to the same slot hole parameters, the second leaky coaxial cable of the configuration (volume and size) and the first leaky coaxial cable have the same radiation characteristics, and only the transmission loss is correspondingly increased. The second leaky coaxial cable of the configuration (volume and size) in this solution is generally less expensive, which is advantageous for cost saving. When applied with a large electrical level allowance, the second leaky coaxial cable not only makes the switching smoother, but also improves the signal-to-noise ratio of an each one of the initial and tail ends of the leaky coaxial cable.

Each of the leaky coaxial cable combination structures includes a first leaky coaxial cable with initial and tail ends, a transition jumper wire, and a second leaky coaxial cable with initial and tail ends, wherein the second leaky coaxial cables of the leaky coaxial cable combination structures of the two areas are combined to form an integral second leaky coaxial cable, and two opposite ends of the second leaky coaxial cable along the length direction are respectively connected to inner ends of the corresponding transition jumper wires at two opposite ends; outer ends of each of the transition jumper wires are respectively connected to the tail ends of the first leaky coaxial cable, and initial ends of two of the first leaky coaxial cables are located at two opposite ends of the strip-shaped elongated area along the length direction.

The configuration (volume and size) of the second leaky coaxial cable and the configuration (volume and size) of the first leaky coaxial cable are the same, and the slot hole parameters of the first leaky coaxial cable and second leaky coaxial cable are different. The first leaky coaxial cable is an initial end of the leaky coaxial cable combination structure, and any second leaky coaxial cable of each of the second leaky coaxial cables is a tail end of the leaky coaxial cable combination structure of the corresponding area. A low attenuation leaky coaxial cable is used as the first cable, and a high radiation leaky coaxial cable is used as the second cable, so that the overall end field intensity is consistent with the designed end field intensity, and the objectives of smoothening a comprehensive loss of the leaky coaxial cable, improving the signal-to-noise ratio of an end coverage area and reducing the size of a switching area are achieved. The flexibility is high, and the effect is good.

After the method according to the present disclosure is adopted, for leaky coaxial cable combination structures of two areas symmetrically arranged with respect to a central area along a length direction of the strip-shaped elongated area, on the premise of ensuring that a comprehensive loss of the leaky coaxial cable is constant. Initial ends of the leaky coaxial cable combination structures of the two areas relatively far from the central area help to reduce radiation to ensure a small transmission loss, and tail ends of the leaky coaxial cable combination structures of the two areas at the central area help to reduce an appropriate transmission loss to increase the radiation performance. The method can improve the signal-to-noise ratio of the end signal coverage area, shorten the signal switching area, stabilize a switching effect, and achieve an objective of smooth switching.

DETAILED DESCRIPTION OF THE INVENTION

A method of arrangement of a leaky coaxial cable combination structures, comprising: providing two leakage coaxial cables, each of the at least two leakage coaxial cables has a narrow body; and providing a jumper wire mechanism between the two leakage coaxial cables; wherein the jumper wire mechanism has two ends, and the two ends are respectively connected to a corresponding end of each of the at least two leakage coaxial cables, wherein the jumper wire mechanism comprises two half jumper wires, one end of one of the two half jumper wires is connected to one end of the leakage coaxial cable, and the other end of the one half jumper wire of the two half jumper wires is connected to one end of the other half jumper wire.

Figure 1:
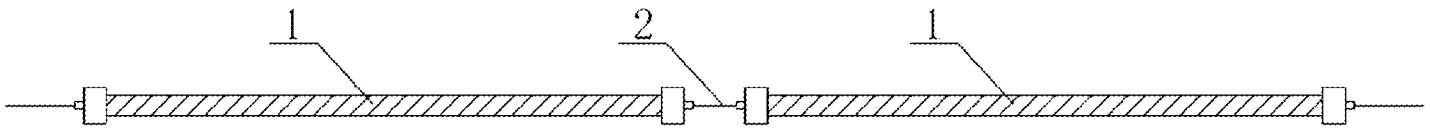
Fig.1 (PRIOR ART)
FIG. 1 shows a schematic view of an existing arrangement of leaky coaxial cables.
Figure 2:
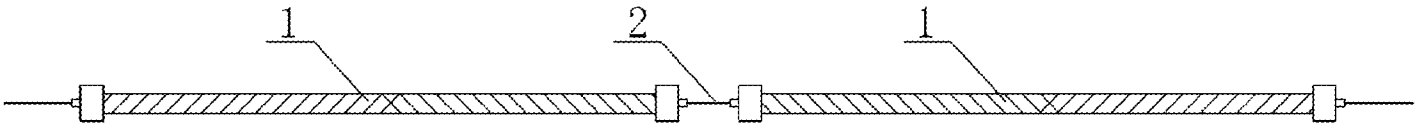
FIG. 2 shows a structural arrangement view in a first solution of the present disclosure.

In the first solution, referring to FIG. 2, each leaky coaxial cable combination structure includes a leaky coaxial cable 1 and a half jumper wire, wherein the half jumper wires of the leaky coaxial cable combination structures of the two areas are combined to form an integral jumper 2. Two opposite ends of the jumper wire 2 are respectively connected to tail ends of corresponding leaky coaxial cables 1 located at the two opposite ends, initial ends of two leaky coaxial cables 1 are located at two opposite ends of the strip-shaped elongated area. A slot hole on each of the leaky coaxial cables 1 has at least two different slot hole parameters. The slot hole parameters include, but are not limited to, a slot hole shape, a gradient pitch, a groove width, a groove length, a grooving inclination angle, a hole spacing, and a combined slot hole pattern.

The slot hole shape is V shape, U shape, vertical strip shape, or inclined strip shape.

Figure 5:
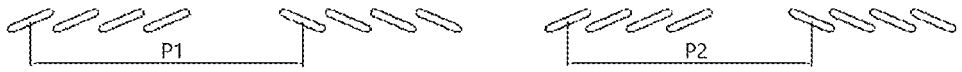
FIG. 5 shows a schematic arrangement view of slot holes of a leaky coaxial cable according to a first embodiment in the first solution of the present disclosure.

In the first embodiment, referring to FIG. 5, each leaky coaxial cables includes slot holes having two pitches, wherein a groove group composed of slot holes with a large pitch P1 is disposed at the initial end of the leaky coaxial cable, and a groove group composed of slot holes with a small pitch P2 is disposed at the tail end of the leaky coaxial cable.

Figure 6:
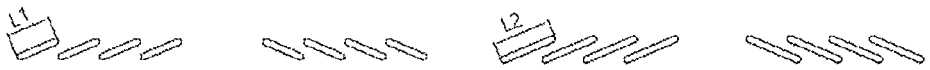
FIG. 6 shows a schematic arrangement view of slot holes of a leaky coaxial cable according to a second embodiment in the first solution of the present disclosure.

In the second embodiment, referring to FIG. 6, each leaky coaxial cable includes slot holes having two groove lengths, wherein a groove group composed of slot holes with a relatively small groove length L1 is disposed at the initial end of the leaky coaxial cable, and a groove group composed of slot holes with a relatively large groove length L2 is disposed at the tail end of the leaky coaxial cable.

Figure 7:
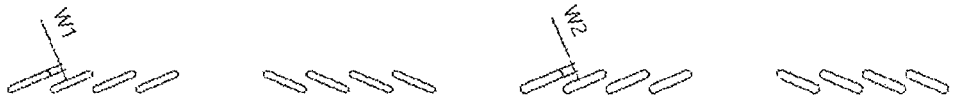
FIG. 7 shows a schematic arrangement view of slot holes of a leaky coaxial cable according to a third embodiment in the first solution of the present disclosure.

In the third embodiment, referring to FIG. 7, each leaky coaxial cable includes slot holes having two groove widths, wherein a groove group composed of slot holes with a relatively small groove width W1 is disposed at the initial end of the leaky coaxial cable, and a groove group composed of slot holes with a relatively large groove width W2 is disposed at the tail end of the leaky coaxial cable.

Figure 8:
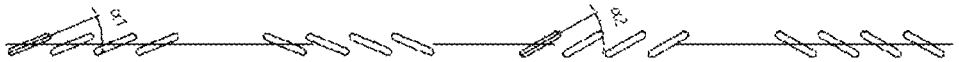
FIG. 8 shows a schematic arrangement view of slot holes of a leaky coaxial cable according to a fourth embodiment in the first solution of the present disclosure.

In the fourth embodiment, referring to FIG. 8, when the slot hole shape is V shape, each of the at least two leaky coaxial cables comprises a first slot group and a second slot group; wherein the first slot group is provided at one end of each of the two leaky coaxial cables, and the first slot group comprises several first slot holes, which have a first pitch; wherein the second slot group is provided at the other end of each of the two leaky coaxial cables, and the second slot group comprises several second slot holes, which have a second pitch smaller than the first pitch. A groove group composed of slot holes with a relatively small grooving inclination angle $\alpha 1$ is disposed at the initial end of the leaky coaxial cable, and a groove group composed of slot holes with a relatively large grooving inclination angle $\alpha 2$ is disposed at the tail end of the leaky coaxial cable.

Figure 9:
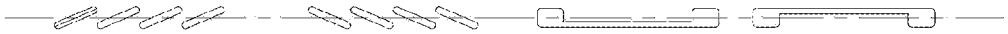
FIG. 9 shows a schematic arrangement view of slot holes of a leaky coaxial cable according to a fifth embodiment in the first solution of the present disclosure.

In the fifth embodiment, referring to FIG. 9, when the leaky coaxial cable is horizontally installed, and the main polarization mode is required to be vertical polarization, each of the leaky coaxial cables has two grooving shapes are V shape and U shape. A groove group with a good transmission performance is disposed at the initial end of the leaky coaxial cable, and a groove group with a good radiation performance is disposed at the tail end of the leaky coaxial cable.

In an embodiment, one leaky coaxial cable is provided with at least two groups of slot holes, including, but not limited to, the above-mentioned five modes used separately or in combination. When the above-mentioned five modes are combined, the modes need to be arranged according to the above-mentioned rules, and there is a negative correlation between the number of slot groups and the comprehensive losses. For specific grooving parameters (size and quantity of grooves), reference is made to the performance of the leaky coaxial cable when the respective grooving parameters (size and quantity of grooves) exist separately.

Figure 3:
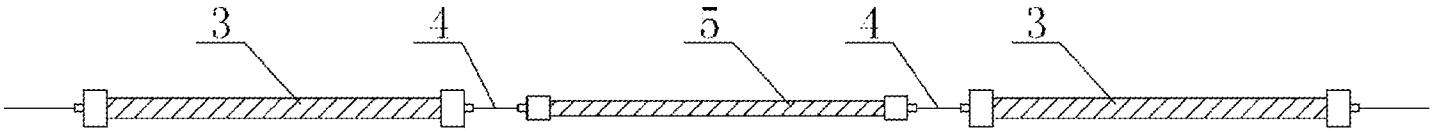
FIG. 3 shows a structural arrangement view in a second solution of the present disclosure.
Figure 4:
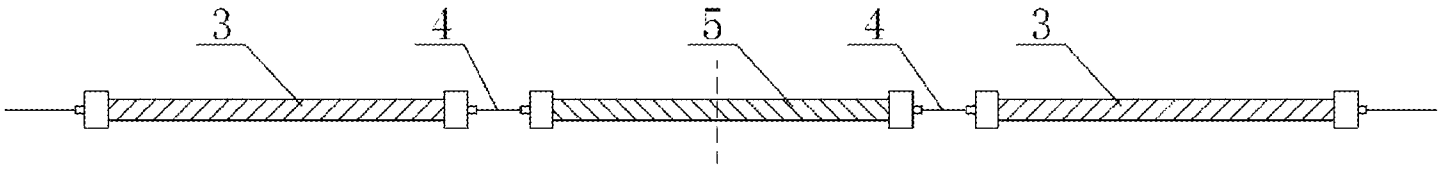
FIG. 4 shows a structural arrangement view in a third solution of the present disclosure.

In the second solution as illustrated by FIG. 3 and the third solutions as illustrated by FIG. 4, each leaky coaxial cable combination structure includes a first leaky coaxial cable 3, a transition jumper wire 4, and a second leaky coaxial cable, where the second leaky coaxial cables of the leaky coaxial cable combination structures of the two areas are combined to form an integral second leaky coaxial cable 5. The two ends of the second leaky coaxial cable 5 are respectively connected to one end of the two transition jumper wires 4, and one end of the two first leaky coaxial cables 3 is respectively connected to the other end of the two transition jumper wires 4, and initial ends of two first leaky coaxial cables 3 are located at two opposite ends of the strip-shaped elongated area along the length direction.

In the second solution, referring to FIG. 3, the configuration (volume and size) of the second leaky coaxial cable 5 is smaller than that of the first leaky coaxial cable 3, slot hole parameters of the first leaky coaxial cable 3 and the second leaky coaxial cable 5 are the same, and the second leaky coaxial cable 5 with a smaller configuration (volume and size) is selected according to a design requirement for switching, so as to achieve an objective of smoothly increasing an end transmission loss and reducing the size of a switching area. Moreover, due to the same slot hole parameters, the second leaky coaxial cable of the configuration (volume and size) and the first leaky coaxial cable have the same radiation characteristics, and only the transmission loss is correspondingly increased. The second leaky coaxial cable of the configuration (volume and size) in this solution is generally less expensive, which is advantageous for cost saving. When applied with a large electrical level allowance, the second leaky coaxial cable not only makes the switching smoother, but also improves the signal-to-noise ratio of each one of the initial and tail ends of the leaky coaxial cable.

In third solution, referring to FIG. 4, the configuration (volume and size) of the second leaky coaxial cable 5 and the configuration (volume and size) of the first leaky coaxial cable 3 are the same, and the slot hole parameters of the first leaky coaxial cable 3 and second leaky coaxial cable 5 are different. The slot hole parameters include, but are not limited to, a slot hole shape, a gradient pitch, a groove width, a groove length, a grooving inclination angle, a hole spacing, and a combined slot hole pattern. The slot hole shape is V shape, U shape, vertical strip shape, or inclined strip shape. The first leaky coaxial cable is an initial end of the leaky coaxial cable combination structure, and any second leaky coaxial cable of each of the second leaky coaxial cables 5 is a tail end of the leaky coaxial cable combination structure of the corresponding area. The first cable 3 uses a low attenuation leaky coaxial cable, and the second cable 5 uses a high radiation leaky coaxial cable, so that the overall end field intensity is consistent with the designed end field intensity, and the objectives of smoothening a comprehensive loss of the leaky coaxial cable, improving the signal-to-noise ratio of an end coverage area and reducing the size of a switching area are achieved. The flexibility is high, and the effect is good.

Figure 10:
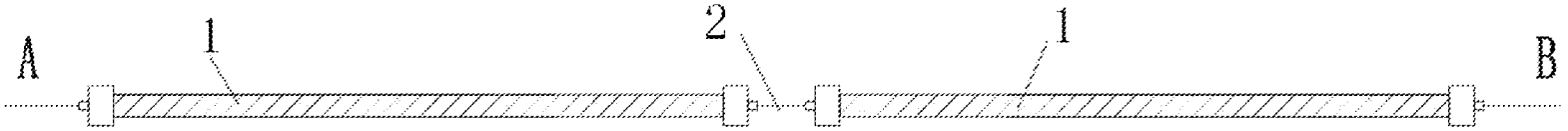
FIG. 10 shows a structural arrangement view of a specific application embodiment of the present disclosure.

In an embodiment, referring to FIG. 10, each leaky coaxial cable combination structure includes a leaky coaxial cable 1 and a half jumper wire, wherein the half jumper wires of the leaky coaxial cable combination structures of the two areas are combined to form an integral jumper 2. In a certain LTE 1.8G system built by a leaky coaxial cable, a cell A is spaced apart from a cell B by 1.2 km, and two leaky coaxial cables which are each 600 m long are connected by means of a jumper wire. Provided that switching is performed at the 600 m position in the middle of the section AB (refer to relative signal strength criteria with threshold specifications), the designed condition is: RSRP trigger threshold <−100 dBm, and the signal difference between cells A and B is 6 dB. A leaky coaxial cable using the conventional coverage mode has an attenuation constant of 3.8 dB/hm and a coupling loss of 65 dB (95%, 2 m). The parameters of the leaky coaxial cable set by using the first solution are: 3.6 dB/hm, 68 dB & 5.6 dB/hm, 60 dB.

Figure 11:
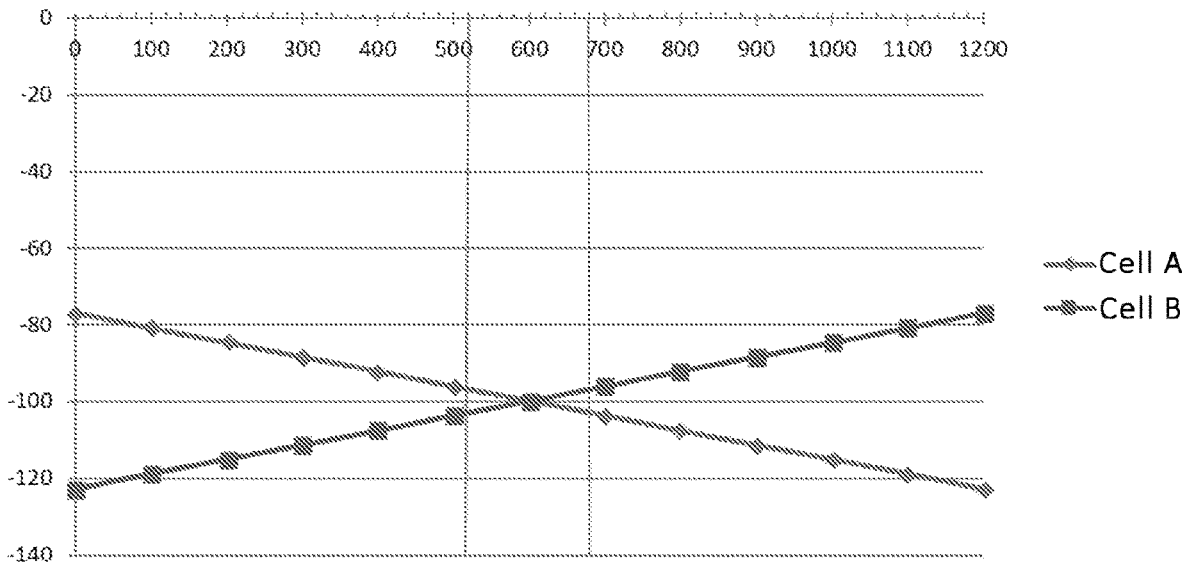
Fig.11 (PRIOR ART)
FIG. 11 shows a schematic view of a signal field intensity using a conventional coverage mode in section AB of FIG. 10.

A schematic view of the signal field intensity of the section AB in the conventional coverage mode is shown in FIG. 11. Calculated according to a switching threshold, the length of this area from that the trigger threshold <−100 dBm to that the signal difference between cells A and B of 6 dB is L=6/(3.8*2)≈0.79 hm, namely 79 m. In the area of about 160 m (520-680 m) of the switching area (switching from cell A to cell B or switching from cell B to cell A) (in this case, an about 10 meters extension of the switching area resulting from the switching time*the moving speed of a mobile station is neglected), the Signal-to-Noise Ratio (SNR)<6 dB, and after the switching is completed, the SNR will be greater than 6 dB.

Figure 12:
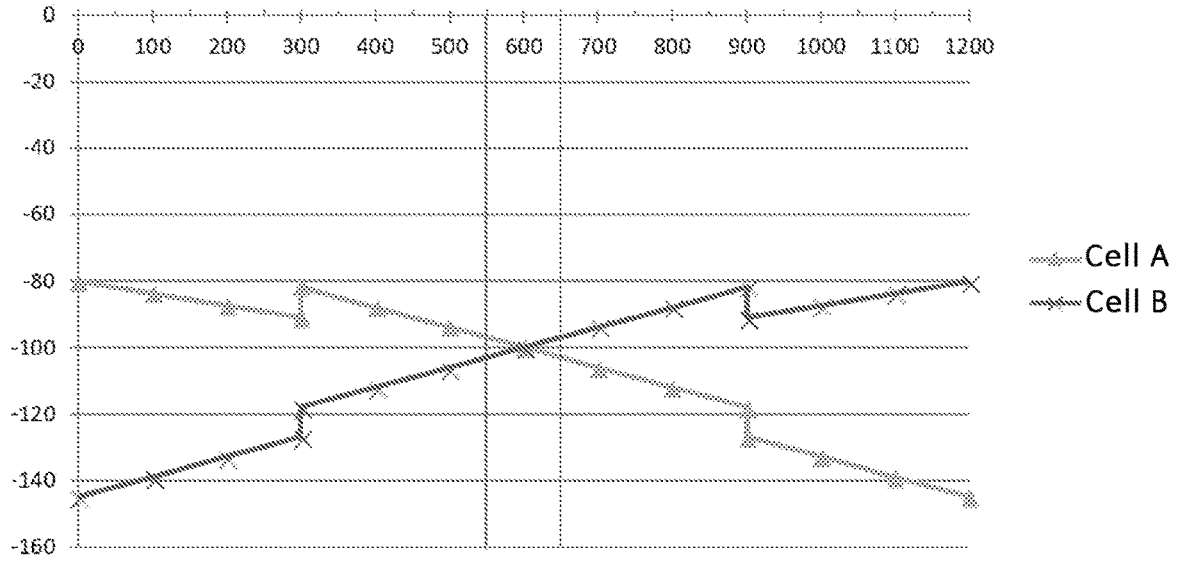
FIG. 12 shows a schematic view of a signal field intensity after the first solution is used in the section AB of FIG. 10.

A schematic view of the signal field intensity of the section AB in the coverage mode of this solution is shown in FIG. 12. Calculated according to a switching threshold, the length of this area from the trigger threshold <−100 dBm to that the signal difference between cells A and B of 6 dB is L=6/(6*2)=0.5 hm, namely 50 m. In the area of about 100 m (550-650 m) of the switching area (switching from cell A to cell B or switching from cell B to cell A) (in this case, an about 10 meters extension of the switching area resulting from the switching time*the moving speed of a mobile station is neglected), the SNR<6 dB, and after the switching is completed, the SNR will be greater than 6 dB. Relatively speaking, the switching area of the coverage mode of this solution is shortened by about 160−100=60 m compared with the coverage mode, and the SNR is greater than 6 dB in the 60 m area.

The three solutions can be used to solve the problems of excessive field intensity at the initial end of the leaky coaxial cable, too long tail end switching area, being difficult to switch the switching area and low signal-to-noise ratio, and can be selected specifically according to actual application scenarios and functional requirements. This solution has guiding significance for the effective application of the leaky coaxial cable in long-distance laying arrangement (the distance between adjacent signal source device information source equipment >200 m) and the application of a leaky coaxial cable-based MIMO solution.

The specific embodiments of the present disclosure have been described in detail above, but the contents are only preferred embodiments of the present disclosure and cannot be considered as limiting the implementation scope of the present disclosure. Any equivalent changes and improvements made in accordance with the application scope of the present disclosure shall still fall within the scope of this patent.

The invention claimed is:

1. A method of arrangement of a leaky coaxial cable combination structures, comprising:

providing two leakage coaxial cables, each of the at least two leakage coaxial cables has a narrow body; and providing a jumper wire mechanism between the two leakage coaxial cables;

wherein the jumper wire mechanism comprises two half jumper wires, one end of each one of the two half jumper wires is connected to a respective end of the two leakage coaxial cables, and the other end of each one of the half jumper wires are connected to each other.

2. The method according to claim 1, wherein:

each of the two leaky coaxial cables comprises a seventh slot group and a eighth slot group;

wherein the seventh slot group is provided at one end of each of the two leaky coaxial cables, and the seventh slot group comprises several seventh slot holes, which have a first slotting angle; and wherein the eighth slot group is provided at the other end of each of the two leaky coaxial cables, and the eighth slot group comprises several eighth slot holes, which have a second slotting angle larger than the first slotting angle.

3. The method according to claim 1, wherein each of the two leaky coaxial cables has at least eight slot holes, the shape of each of the at least eight slot holes is V shape, U shape, vertical strip shape, or inclined strip shape.

4. The method according to claim 1, wherein:

each of the two leaky coaxial cables comprises a first slot group and a second slot group;

wherein the first slot group is provided at one end of each of the two leaky coaxial cables, and the first slot group comprises several first slot holes, which have a first pitch;

wherein the second slot group is provided at the other end of each of the two leaky coaxial cables, and the second slot group comprises several second slot holes, which have a second pitch smaller than the first pitch.

5. The method according to claim 1, wherein:

each of the two leaky coaxial cables comprises a third slot group and a fourth slot group;

wherein the third slot group is provided at one end of each of the two leaky coaxial cables, and the third slot group comprises several third slot holes, which have a first slot length;

wherein the fourth slot group is provided at the other end of each of the two leaky coaxial cables, and the fourth slot group comprises several fourth slot holes, which have a second slot length smaller than the first slot length.

6. The method according to claim 1, wherein:

each of the two leaky coaxial cables comprises a fifth slot group and a sixth slot group;

wherein the fifth slot group is provided at one end of each of the two leaky coaxial cables, and the fifth slot group comprises several fifth slot holes, which have a first slot width;

wherein the sixth slot group is provided at the other end of each of the two leaky coaxial cables, and the sixth slot group comprises several sixth slot holes, which have second slot width smaller than the first slot width.

* * * * *